US009455080B2

(12) United States Patent
Kuroda et al.

(10) Patent No.: US 9,455,080 B2
(45) Date of Patent: Sep. 27, 2016

(54) REACTOR

(71) Applicant: TDK CORPORATION, Tokyo (JP)

(72) Inventors: Tomofumi Kuroda, Tokyo (JP); Yu Sakurai, Tokyo (JP); Hideyuki Itoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/602,821

(22) Filed: Jan. 22, 2015

(65) Prior Publication Data

US 2015/0213942 A1 Jul. 30, 2015

(30) Foreign Application Priority Data

Jan. 28, 2014 (JP) ..... 2014-013328

(51) Int. Cl.

| | |
|---|---|
| ***H01F 17/06*** | (2006.01) |
| ***H01F 27/24*** | (2006.01) |
| ***H01F 21/06*** | (2006.01) |
| ***H01F 27/02*** | (2006.01) |
| ***H01F 27/29*** | (2006.01) |
| ***H01F 27/255*** | (2006.01) |
| ***H01F 27/34*** | (2006.01) |
| ***H01F 3/10*** | (2006.01) |
| ***H01F 37/00*** | (2006.01) |
| *H01F 3/14* | (2006.01) |

(52) U.S. Cl.

CPC ..... *H01F 27/255* (2013.01); *H01F 3/10* (2013.01); *H01F 27/34* (2013.01); *H01F 37/00* (2013.01); *H01F 3/14* (2013.01); *H01F 2003/106* (2013.01)

(58) Field of Classification Search

CPC ..... H01F 27/255; H01F 27/34; H01F 2003/106; H01F 3/14; H01F 37/00

USPC ..... 336/178, 212, 131, 175

See application file for complete search history.

(56) References Cited

U.S. PATENT DOCUMENTS

| | | | | |
|---|---|---|---|---|
| 2,947,961 | A * | 8/1960 | Wahlgren | H01F 27/245 336/212 |
| 3,668,589 | A * | 6/1972 | Wilkinson | H01F 27/255 336/212 |
| 4,149,135 | A * | 4/1979 | Roespel | H01F 5/04 29/605 |
| 5,345,209 | A * | 9/1994 | Saitoh | H01F 17/043 336/134 |
| 5,530,416 | A * | 6/1996 | Wakamatsu | H01F 17/045 336/192 |
| 5,587,694 | A * | 12/1996 | Minato | H01F 3/14 336/178 |
| 7,057,486 | B2 * | 6/2006 | Kiko | H01F 17/043 336/178 |

(Continued)

FOREIGN PATENT DOCUMENTS

| | | |
|---|---|---|
| JP | S6015908 A | 1/1985 |
| JP | 2007-128951 A | 5/2007 |

*Primary Examiner* — Elvin G Enad
*Assistant Examiner* — Kazi Hossain
(74) *Attorney, Agent, or Firm* — Oliff PLC

(57) ABSTRACT

A reactor using a composite magnetic core in which a ferrite core and a soft magnetic metal core are combined. The reactor is composed of a pair of yoke portion magnetic portions composed of ferrite, winding portion core(s) disposed between the opposite planes of the yoke portion cores, and coil(s) winding around the winding portion core(s). The winding portion core(s) is/are formed using a soft magnetic metal core with a substantially constant cross sectional area. Junction portion cores composed of soft magnetic metal powder cores with a tabular shape are disposed at the spaces where the winding portion core(s) face(s) the yoke portion cores, and the area of the part where the junction portion core faces the yoke portion core is made to be 1.3 to 4.0 times that of the section of the winding portion core.

4 Claims, 4 Drawing Sheets

(56) References Cited

U.S. PATENT DOCUMENTS 8,458,890 B2 * 6/2013 Sakamoto ..... H01F 1/26 29/602.1
8,528,190 B2 * 9/2013 Lotfi ..... H01F 27/027 264/272.11
2004/0085173 A1 * 5/2004 Decristofaro ..... H01F 27/245 336/178
2011/0001595 A1 * 1/2011 Kudo ..... H01F 17/045 336/192
2013/0088317 A1 * 4/2013 Tawara ..... H01F 17/06 336/212

* cited by examiner

REACTOR

The present invention relates to a reactor used in a circuit of a power supply or a power conditioner of a solar photovoltaic system or the like. Specifically, the present invention relates to an improvement for the DC (Direct Current) superposition characteristic of an inductance.

BACKGROUND

As a conventional magnetic core material for the reactor, a stacked electromagnetic steel plate or a soft magnetic metal power core can be used. Although the stacked electromagnetic steel plate has a high saturation magnetic flux density, it has a problem of that if the driving frequency in the circuit of the power supply exceeds 10 kHz, the iron loss will become greater and will cause a decreased efficiency. The soft magnetic metal powder core is widely used as the driving frequency becomes higher because its iron loss at a high frequency is less than that of the stacked electromagnetic steel plate. However, the iron loss of the soft magnetic metal powder core may not low enough, and some problems are there such as the saturation magnetic flux density is inferior to that of the electromagnetic steel plate.

On the other hand, the ferrite core is well known as a magnetic core material with a small iron loss at a high frequency. However, the ferrite core has a lower saturation magnetic flux density compared to the stacked electromagnetic steel plate or the soft magnetic metal powder core, thus a design is needed to provide a relatively large section in the magnetic core so as to avoid the magnetic saturation when a large current is applied. In this respect, a problem rises that the shape becomes larger.

In Patent Document 1, a reactor has been disclosed in which a composite magnetic core is used as the magnetic core material so that the loss, size and the weight of the core are reduced, wherein the composite magnetic core is obtained by combining a soft magnetic metal powder core used in the portion for winding the coil and a fertile core used in the yoke portion.

PATENT DOCUMENTS

Patent Document 1: JP-A-2007-128951

SUMMARY

The loss at a high frequency will decrease when a composite magnetic core is prepared by combining the ferrite core and the soft magnetic metal core. However, when the Fe powder magnetic core or the FeSi alloy powder magnetic core both of which have a high saturation magnetic flux density is used as the soft magnetic metal core, the composite magnetic core in which the soft, magnetic metal core and the ferrite core are combined will have an inferior DC superposition characteristic of the inductance compared to the core only with the soft magnetic metal core. As described in Patent Document 1, the saturation magnetic flux density of the ferrite core is lower than that of the soft magnetic metal core, so an improved effect may be obtained by increasing the cross sectional area of the ferrite core. However, the problem has not been fundamentally solved.

FIG. 4 and FIG. 5 show an example in the prior art. FIG. 4 and FIG. 5 are used to find out the reason why the DC superposition characteristic of the inductance deteriorates in the composite magnetic core in which the ferrite core and the soft metal magnetic core are combined. FIG. 4 and FIG. 5 schematically show the configuration of the junction portion for the ferrite core 21 and the soft magnetic metal core 22 as well as the flow of magnetic flux 23.

The arrows in the drawings represent the magnetic flux 23. When the magnetic flux 23 in the soft magnetic metal core 22 is equivalent to that in the ferrite core 21, the number of the arrows is represented by a same number in either magnetic core. Since the magnetic flux 23 per unit area is referred to as the magnetic flux density, the narrower the space among arrows is, the higher the magnetic flux density is.

As the ferrite core 21 has a lower saturation magnetic flux density compared to the soil magnetic metal core 22, the area of the section perpendicular to the direction of the magnetic flux in the ferrite core 21 is set to be larger than that of the section perpendicular to the direction of the magnetic flux in the soft magnetic metal core 22 so as to enable a large magnetic flux to flow in the ferrite core. The end part of the soft magnetic metal core is connected to the ferrite core, and the area of the part in which the soft magnetic metal core 22 and the ferrite core 21 face to each other is the same with the cross sectional area of the soft magnetic metal core 22.

FIG. 4 shows a case in which the current flowing in the coil is small, i.e., a case in which the magnetic flux 23 excited in the soft magnetic metal core of the winding portion is small. As the magnetic flux density of the soft magnetic metal core 22 is smaller than the saturation magnetic flux density of the ferrite core 21, the magnetic flux 23 flowing from the soft magnetic metal core 22 can directly flow into the ferrite core 21 without a leakage of the magnetic flux 23. When the current flowing in the coil is small, the decrease of the inductance is suppressed to be low.

FIG. 5 shows a case in which the current flowing in the coil is large, i.e., a case in which the magnetic flux excited in the winding portion core is large. If the magnetic flux density of the soft magnetic metal core 22 is larger compared to the saturation magnetic flux density of the ferrite core 21, the magnetic flux 23 flowing from the soft magnetic metal core 22 cannot directly flow into the ferrite core 21 through the junction portion. Instead, the magnetic flux 23 will flow through the surrounding space as shown by the dotted arrows. In other words, the magnetic flux 23 flows in the space with a relative permeability of 1, so the effective-permeability decreases and the inductance also decreases sharply. That is, when a high current is superimposed by which the magnetic flux density of the soft magnetic metal core 22 is made to be larger than the saturation magnetic flux density of the ferrite 21, there is a problem that the inductance decreases. In addition, as a leakage of the magnetic flux 23 happens, the cupper loss due to the interlink of the magnetic flux with the coil also increases.

As such, in the prior art, only the cross sectional areas of the ferrite core and the soft magnetic metal core are considered, thus the magnetic saturation in the junction portion is neglected and the DC superposition characteristic of the inductance is not sufficient.

The present invention is made to solve the problems mentioned above and aims to improve the DC superposition characteristic of the inductance in the reactor using a composite magnetic core in which the ferrite core and the soft magnetic metal core are combined.

The reactor of the present invention is composed of a pair of yoke portion cores which are composed of ferrite, winding portion core(s) disposed between the opposing planes of the yoke portion cores, and coil(s) wound around the winding portion core, wherein the winding portion, core(s) is/are composed of a soft magnetic metal core with a substantially constant cross sectional area, junction portion cores composed of a tabular soft magnetic metal powder core are disposed in the spaces where the winding portion core(s) face(s) the yoke portion cores, and the area of the part where the junction portion core faces the yoke portion core is 1.3 to 4.0 times the cross sectional area of the winding portion core. As such, the DC superposition characteristic of the inductance can be improved in the reactor of a composite magnetic core in which the ferrite core and the soft magnetic metal core are combined to be used.

Further, a gap is preferably disposed in the space where the yoke portion core faces the junction portion core or in the space where the winding portion core feces the junction portion core in the reactor of the present invention. In this way, the magnetic permeability may be adjusted and the inductance of the reactor may be adjusted into any level easily.

With the present invention, the DC superposition characteristic of the inductance may be improved in the reactor of the composite magnetic core in which the ferrite core and the soft magnetic metal core are combined to be used.

DETAILED DESCRIPTION OF EMBODIMENTS

Figure 6:
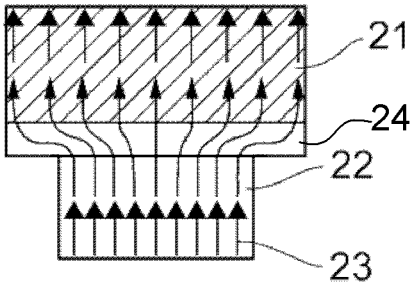
FIG. 6 is a drawing schematically showing the configuration of the junction portion for the ferrite core and the soft magnetic metal core and the How of the magnetic flux in one embodiment of the present invention.

In the composite magnetic core in which the ferrite core and the soft magnetic metal core are combined, the inductance under DC superposition may be improved by preventing the magnetic saturation of the ferrite in the plane where the magnetic flux flows to and fro between the ferrite core and the soft magnetic metal core. FIG. 6 is used to describe the improved effect on the DC superposition characteristic of the inductance provided by the present invention.

In FIG. 6, the junction portion core 24 composed of a tabular soft magnetic metal powder core is inserted between the ferrite core 21 and the soft magnetic metal core 22, and the area of the section perpendicular to the magnetic flux of the junction portion core 24 is larger than that of the section of the soft magnetic metal core 22.

By inserting a junction portion core 24 with a large cross sectional area, the magnetic flux density of the junction portion core 24 may be decreased compared to that of the soft magnetic metal core 22. Even in a case of that the current flowing in the coil is large, the magnetic flux 23 flowing from the soft magnetic metal core 22 may flow into the ferrite core 21 with no magnetic flux being leaked to the circumambience by decreasing the magnetic flux density in the junction portion core 24. In this way, the decrease of the effective permeability can be suppressed. As a result, a high inductance can be obtained even under DC superposition.

The preferable embodiments of the present invention will be described with reference to the drawings hereinafter.

Figure 1A:
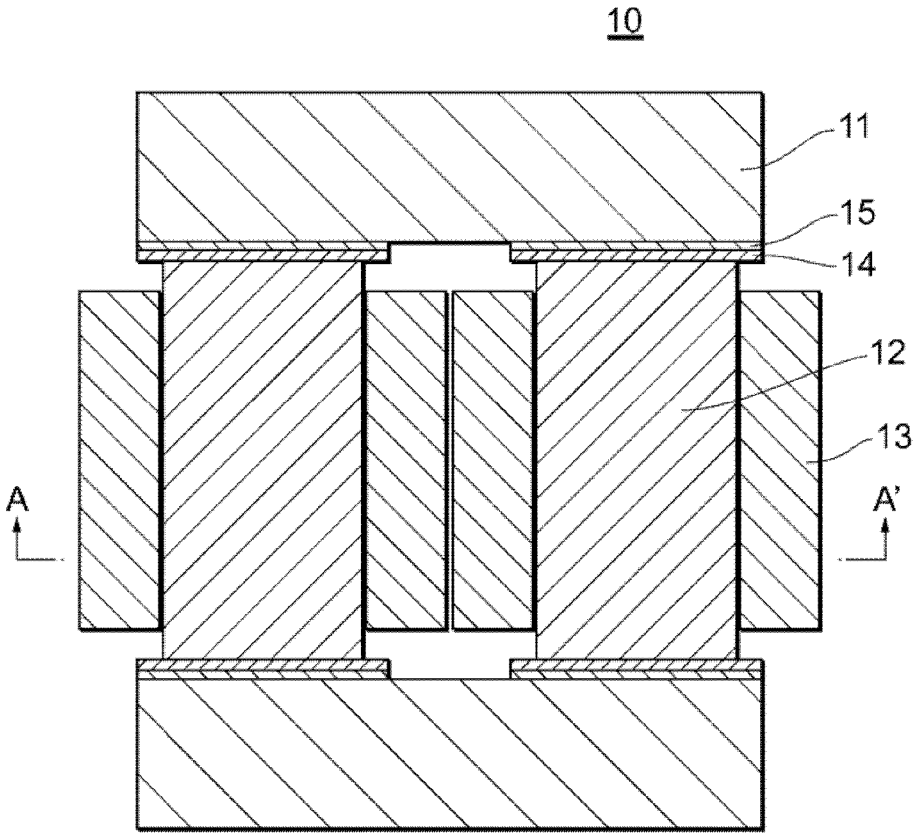
FIG. 1A is a sectional view showing the configuration of the reactor in one embodiment of the present invention.
Figure 1B:
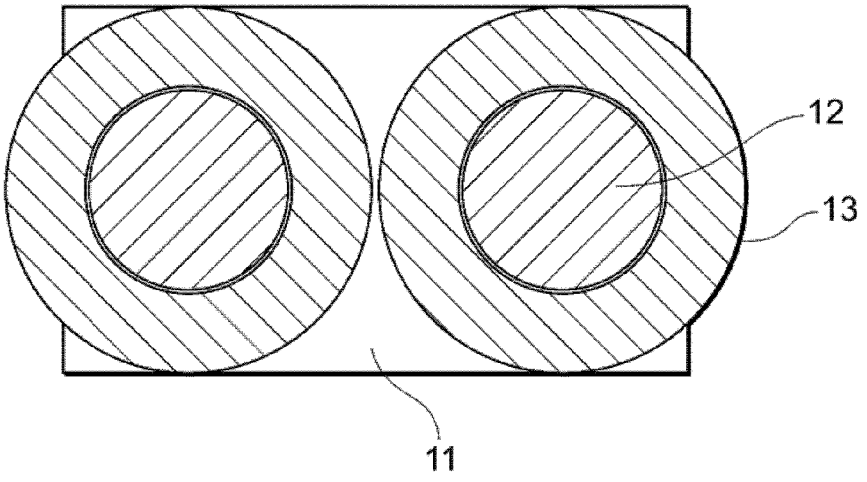
FIG. 1B is a sectional view of the reactor shown in FIG. 1A which is cut along the A-A' line.

FIGS. 1A and 1B are drawings showing the configuration of the reactor 10. FIG. 1B is a sectional view of the reactor shown in FIG. 1A which is cut along the A-A' line. The reactor 10 is provided with two opposite yoke portion cores 11, winding portion cores 12 disposed between the two yoke portion cores 11, and coils 13 winding around the winding portion cores 12. In addition, a junction portion core 14 is disposed at the space between the yoke portion core 11 and the winding portion core 12. The coil 13 may be directly wound around the winding portion core 12 or may be wound around a bobbin.

The ferrite core is used in the yoke portion 11. The ferrite core has a substantially low loss compared to the soft magnetic metal core but has a low saturation magnetic flux density. As no coil 13 is wound around the yoke portion core 11, the size of the coils 13 will not be affected even if the width or the thickness of the yoke portion cores is increased. Thus, the low saturation magnetic flux density will be covered by increasing the cross sectional area of the yoke portion cores 11. The cross sectional area of the yoke portion cores 11 refers to the area of the section perpendicular to the direction of the magnetic flux, and is obtained by multiplying the width by the thickness. As the ferrite core is easier to be formed than the soft magnetic metal core, it will be quite easy to prepare a magnetic core with a large core cross sectional area. The ferrite core preferably uses MnZn based ferrite. The MnZn based ferrite is good for the miniaturization for the core because it has less loss and higher saturation magnetic flux density than other ferrites.

The winding portion core 12 uses the soft magnetic metal core. An iron powder core, a FeSi alloy powder core, a stacked electromagnetic steel plate or an amorphous core is preferably used as the soft magnetic metal core. Such a soft magnetic metal core has a higher saturation magnetic flux density than the ferrite core, thus the cross sectional area of the core can be reduced which is good for the miniaturization. The cross sectional area of the winding portion core 12 is substantially the same in the direction of the magnetic flux. In this respect, uniform excitation is possible in the winding portion core 12. The direction of the magnetic flux is the same with that of the magnetic field produced by the coil 13 and corresponds to the direction of the axis of the coil 13.

The junction portion core 14 uses a tabular magnetic metal powder core. The junction portion core 14 is not necessarily a same core with the winding portion core 12. An iron powder core or a FeSi alloy powder core is preferably used as the soft magnetic metal powder core. The iron powder core or the FeSi alloy powder core has a high saturation magnetic flux density, thus the flow of the magnetic flux will be sufficiently improved. In addition, as the resistance of the soft magnetic metal powder core is quite high, if is hard for an eddy current to flow in the plane of the tabular core, thus the loss will not increase. Especially, as a tabular core can be molded even under a relatively low stress, the iron powder core is preferably used as the soft magnetic metal powder core.

The area of the junction portion core 14 is made to be 1.3 to 4.0 times that of the section of the winding portion core 12. When the area of the junction portion core is smaller than the lower limit of such a range, the magnetic flux density of the magnetic flux flowing from the winding portion core 12 will not be sufficiently decreased and the Inductance under DC superposition decreases. When the area of the junction portion core 14 is bigger than the upper limit of such a range, it is necessary to enlarge the opposite yoke portion cores 11 so that the miniaturization will not be achieved.

The thickness of the junction portion core 14 is preferably made to be 0.5 mm or more. When the thickness of the junction portion core 14 is smaller than 0.5 mm, the magnetic flux density of the magnetic flux flowing from the winding portion core 12 will not be sufficiently decreased and the inductance under DC superposition decreases. The inductance will be sufficiently improved when the thickness of the junction portion core 14 is thick, but the miniaturization will not be achieved if the thickness is too thick. Further, if the thickness of the tabular soft magnetic metal powder core becomes thinner than 1.0 mm, it will be hard to be molded and cracks are likely to be generated during treatment. Therefore, it is appropriate to control the thickness in the range of 1.0 to 2.0 mm.

At least one set of the winding portion core 12 is disposed between the opposite yoke magnetic cores 11. From the viewpoint of miniaturization, the winding portion core 12 is preferably one set or two sets.

According to the number of the sets of the winding portion core 12, the number of the parts where the yoke portion core 11 and the winding portion core 12 face to each other will change accordingly. However, in the case of that all the parts are inserted with the junction portion core 14, the best effect will be obtained in the improvement of the inductance.

One set of winding portion core 12 can be composed of one soft magnetic metal core, and also can be made of two or more separated parts.

Gaps 15 for adjusting the magnetic permeability can also be disposed in the path of the magnetic loop formed by the yoke portion cores 11 and the winding portion cores 12. No matter the gaps 15 are present or not, the effect of inductance improvement produced in the present invention can be produced. And the use of the gaps 15 can make it more freely in the design of the reactor 10, i.e., the reactor 10 can be designed to have an arbitrary inductance. The position to which the gaps 15 are disposed is not particularly restricted, but the gaps 15 are preferably inserted into the spaces between the yoke portion cores 11 and the junction portion cores 14 or into the spaces between the winding portion cores 12 and the junction portion cores 14 from the viewpoint of easy operation. The gaps 15 can be made of a kind of material with a lower magnetic permeability than the winding portion core, and a nonmagnetic and insulating material such as a resin or a ceramic material is preferred to be used.

Figure 2A:
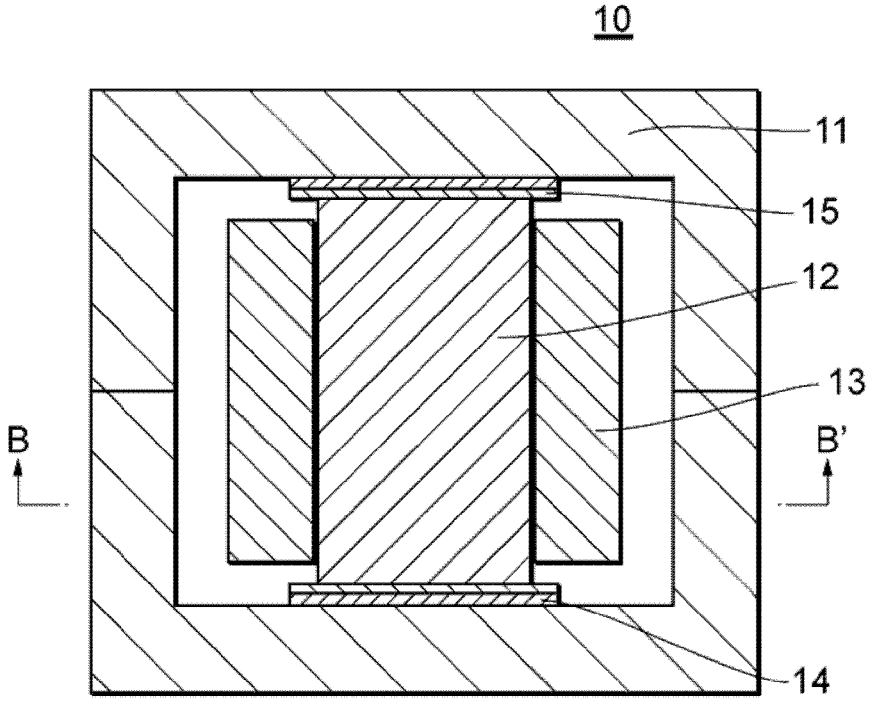
FIG. 2A is a sectional view showing the configuration of the reactor in another embodiment of the present invention.
Figure 2B:
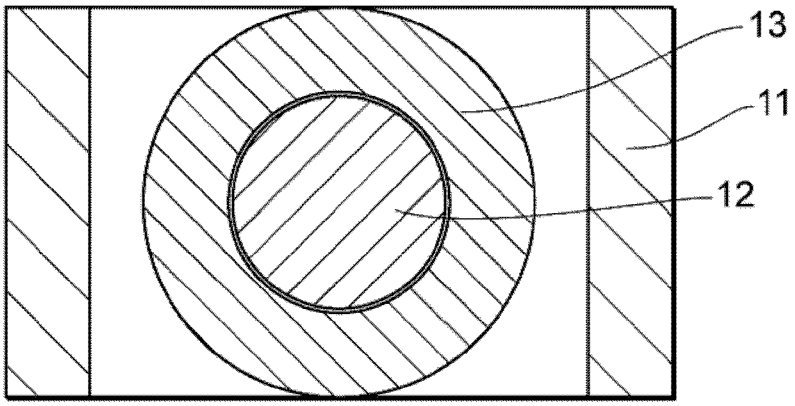
FIG. 2B is a sectional view of the reactor shown in FIG. 2A which is cut along the B-B' line.

FIG. 2 is a sectional view showing the configuration of the reactor in another embodiment of the present invention. FIG. 2B is a sectional view of the reactor shown in FIG. 2A which is cut along the B-B' line. The yoke portion core 11 is a ferrite core shaped "□" like and is provided with a back portion and foot portions at both ends. The winding portion core 12 is a soft magnetic metal core. The yoke portion cores 11 shaped like "□" are opposite to each other to form a "□" shaped magnetic loop as shown in FIG. 2. One set of winding portion core 12 is disposed at the central part of the yoke portion cores 11, and the junction portion cores 14 are disposed at the two spaces where the yoke portion cores 11 face the winding portion core 12. The area of the junction portion core is 1.3 to 4.0 times that of the section of the winding portion core. Then, the coil 13 with a defined number of turns is wound around the winding portion core 12 to constitute the reactor 10. The embodiment shown in FIG. 2 is substantially the same as that shown in FIG. 1 except for the shape of the yoke portion core 11.

The preferable embodiments of the present invention have been described above. However, the present invention is not limited to these embodiments. The present invention can be variously modified without departing from the spirit and scope.

EXAMPLES

Example 1

With respect to the embodiment shown in FIG. 1, the properties were compared based on the shape (the area and the thickness) of the junction portion core 14 and the presence of the gap 15.

Examples 1-1 to 1-5 and Comparative Examples 1-1 to 1-2

A cuboid MnZn ferrite core (PE22, produced by TDK Corporation) was used as the yoke portion core, and two yoke portion cores were prepared with a length of 80 mm, a width of 45 mm and a thickness of 20 mm.

An iron powder core was used as the winding portion core. The height of iron powder core was 25 mm, and the diameter of the winding portion was 24 mm. The Somaloy 110*i* produced by Höganäs AB corporation was used as the iron powder. The iron powder was filled into a mold coated with zinc stearate as the lubricant and was then subjected to a pressing forming under a pressure of 780 MPa to provide a molded body with a specified shape. The molded body was annealed at 500° C. to provide the iron powder core. Two obtained iron powder cores were bonded to constitute one set of the winding portion core, and two sets of such winding portion cores were prepared.

A tabular iron powder core was used as the junction portion core. The junction portion core was prepared with the shapes (the area and the thickness) shown in Table 1, and four sheets of junction portion cores were prepared. Regarding the cores in which the area was substantially large relative to the thickness, the filling of the powders will became nonuniform while molding. Thus, in Examples 1-4 and 1-5, two sheets of cores with half of the desired area were bonded using a binder to form a size listed in Table 1. The iron powder core for the junction portion core was prepared in the same way as the iron powder core for the winding portion core except for the shape.

Two sets of winding portion cores were disposed between two opposite yoke portion cores, and the junction portion cores were disposed at four spaces where the yoke portion cores faced the winding portion cores. When the area of the junction portion core was larger than that of the section of the winding portion core, the junction portion core was disposed in such a manner that the whole end part of the winding portion core laced the junction portion core. With respect to the part where the junction portion core faced the yoke portion core, the junction portion core was disposed in such a manner that the whole area of the junction portion core faced the yoke portion core.

A coil with a number of turns of 44 was wound around the winding portion of the winding portion core to provide a reactor (Examples 1-1 to 1-5 and Comparative Examples 1-1 to 1-2)

Comparative Example 1-3

Figure 3A:
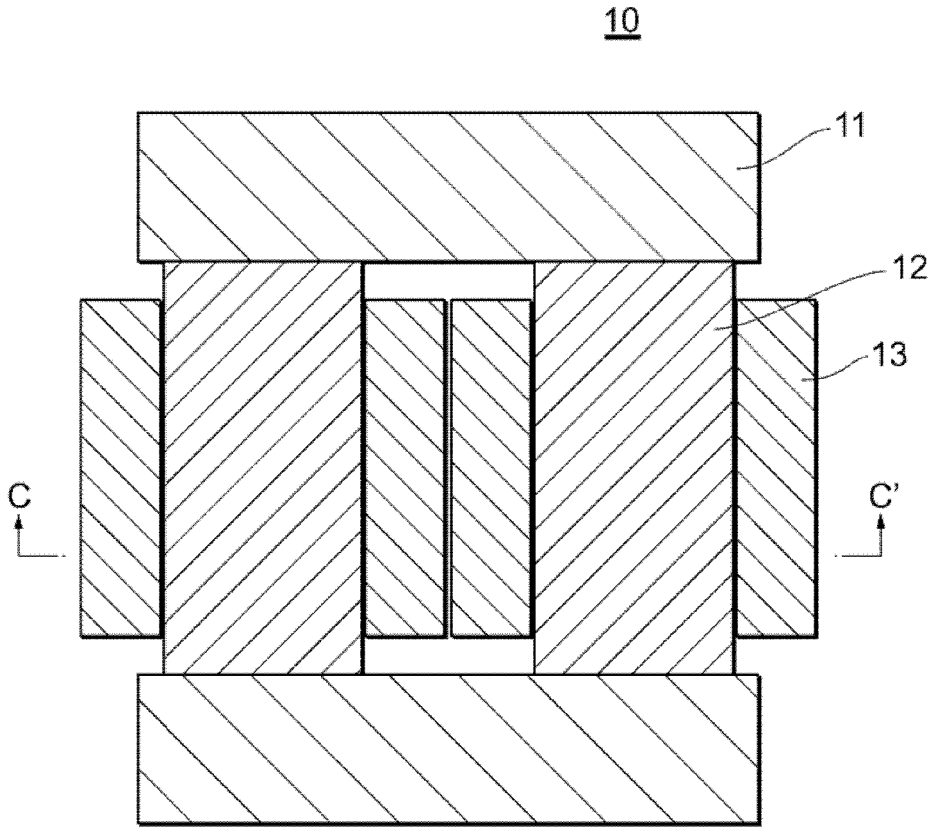
Prior Art Figure3A
FIG. 3A is a sectional view showing the configuration of the reactor in the prior art.
Figure 3B:
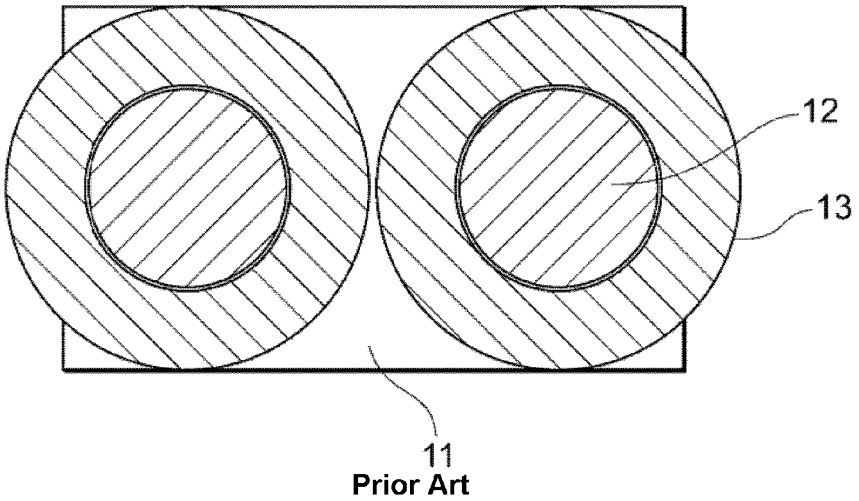
Prior Art Figure3B
FIG. 3B is a sectional view of the reactor shown in FIG. 3A which is cut along the C-C' line.
Figure 4:
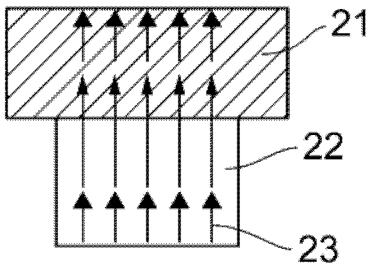
Prior Art Figure4
FIG. 4 is a drawing schematically showing the configuration of the junction portion for the ferrite core and the soft magnetic metal core and the flow of the magnetic flux in the prior art.
Figure 5:
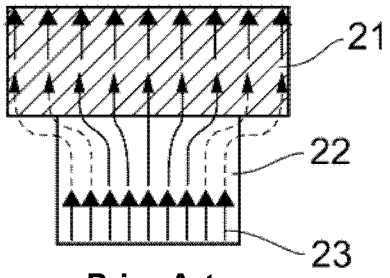
Prior Art Figure5
FIG. 5 is a drawing schematically showing the configuration of the junction portion for the ferrite core and the soft magnetic metal core and the flow of the magnetic flux in the prior art.

Further, in the embodiment shown in FIG. 3, the properties were evaluated on the conventional configuration in which no junction portion core was disposed in the space between the yoke portion core and the winding portion core. In addition, FIG. 3B was a sectional view of the reactor shown in FIG. 3A which was cut along the C-C' line. A reactor (Comparative Example 1-3) was made in the same way as in Comparative Example 1-2 except that no junction portion core was disposed in the space between the yoke portion core and the winding portion core.

Comparative Example 1-4

The properties of the reactor were evaluated in which a stacked electromagnetic steel plate was used as the winding portion core in the embodiment shown in FIG. 1. The stacked electromagnetic steel plate which was a non-oriented electromagnetic plate of a thickness of 0.1 mm was cut to a size of 30 mm×30 mm. And then 10 sheets of such plates were stacked to form one junction portion core. A reactor was prepared in the same way as in Example 1-3 except for the material for the junction portion core (Comparative Example 1-4).

The inductance and the iron loss at a high frequency were evaluated for the obtained reactors (Examples 1-1 to 1-5 and Comparative Examples 1-1 to 1-4).

The DC superposition characteristic of the inductance was measured by using a LCR meter (4284A, produced by Agilent Technologies Corporation) and a DC bias supply (42841A, produced by Agilent Technologies Corporation). According to the needs, a material for gap was inserted into four spaces between the yoke portion cores and the junction portion cores in Examples 1-2 and 1-4 to obtain an initial inductance of 600 μH when no DC current was applied. A PET film with a thickness of 0.15 mm was cut into squares with the side being 40 mm long and was then used as the material for the gap. Regarding the DC superposition characteristic, the inductance was measured when the rated current was 20 A. The thickness of the material for gap and the DC superposition characteristic were shown in Table 1.

The iron loss at a high frequency was measured by using a BH analyzer (SY-8258, produced by Iwatsu Test Instruments Corporation). The f was set to be 20 kHz and Bm was set to be 50 mT for the measurement of the loss of the core. The excitation coil had a number of turns of 25 and the search coil had a number of turns of 5. These two coils were wound around one winding portion core to perform the measurement. The result in the measurement of iron loss was shown in Table 1.

TABLE 1

| | No. | Cross sectional area of the winding portion S1 [mm$^2$] | Junction portion core | Shape of the junction portion core ([mm]) | Thickness of the junction portion core [mm] | Area of the junction portion core S2 [mm$^2$] | Area ratio S2/S1 | Gap [mm] | Inductance L at 0 A [μH] | Inductance L at 20 A [μH] | Reduction rate of L ΔL/L0 | Iron loss at a high frequency Pc 20 kHz, 50 mT [W] |
|---|---|---|---|---|---|---|---|---|---|---|---|---|
| Comparative Example | 1-1 | 452 | Iron powder core | Circular plate (diameter of 22) | 1.00 | 380 | 0.84 | 0.00 | 600 | 350 | −42% | 2.3 |
| Comparative Example | 1-2 | 452 | Iron powder core | Circular plate (diameter of 24) | 1.00 | 452 | 1.00 | 0.00 | 600 | 380 | −37% | 2.3 |
| Example | 1-1 | 452 | Iron powder core | Circular plate (diameter of 28) | 1.00 | 616 | 1.36 | 0.00 | 600 | 520 | −13% | 2.1 |
| Example | 1-2 | 452 | Iron powder core | Rectangular plate (35 × 20) | 2.00 | 700 | 1.55 | 0.15 | 600 | 540 | −10% | 2.3 |
| Example | 1-3 | 452 | Iron powder core | Rectangular plate (30 × 30) | 1.00 | 900 | 1.99 | 0.00 | 600 | 540 | −10% | 2.1 |
| Example | 1-4 | 452 | Iron powder core | Rectangular plate (35 × 40) | 2.00 | 1400 | 3.10 | 0.15 | 600 | 550 | −8% | 2.3 |
| Example | 1-5 | 452 | Iron powder core | Rectangular plate (40 × 40) | 1.00 | 1600 | 3.54 | 0.00 | 600 | 540 | −10% | 2.2 |
| Comparative Example | 1-3 | 452 | None | — | — | — | — | 0.00 | 600 | 370 | −38% | 2.5 |
| Comparative Example | 1-4 | 452 | Stacked steel plate | Rectangular plate (30 × 30) | 1.00 | 900 | 1.99 | 0.00 | 270 | 220 | −19% | 21.2 |

As can be known from Table 1, in Comparative Example 1-3 with a conventional configuration, the inductance at a current with DC superposition of 20 A was decreased by almost 40% compared to the initial inductance (600 μH) to obtain only a low inductance of 370 μH. In Comparative Examples 1-1 to 1-2, although junction portion cores were disposed, the inductance under DC superposition (the current with DC superposition was 20 A) was decreased by 30% or more compared to the initial inductance (600 μH) because the area of the junction portion core was smaller than a level of 1.3 times the cross sectional area of the winding portion core. Junction portion cores were disposed in the reactor of Examples 1-1 to 1-5, and because the ratio of the area of the junction portion core to the cross sectional area of the winding portion core was 1.3 to 4.0, leading to a sufficient improvement effect on the inductance at a current with DC superposition of 20 A. Specifically, the value of the inductance was 500 μH or more, of which the decrease relative to the initial inductance was suppressed to be 30% or less. In addition, it was confirmed that the iron loss at a high frequency was not increased.

In Comparative Example 1-4, the material for the junction portion core was the stacked electromagnetic steel plate. Even no gap was inserted in Comparative Example 1-4, the initial inductance was only 270 μH which did not reach the designed level of 600 μH. In addition, the iron loss at a high frequency in Comparative Example 1-4 was increased to a level about 10 times that in Example 1-3. It was easy to use the stacked electromagnetic steel plate to prepare a tabular magnetic core but a problem was there that the resistance was low in the plane of the steel plate. A very high eddy current would flow in the plane perpendicular to the magnetic flux at a high frequency, thus the inductance decreased due to the eddy current and the loss was also increased. In contrast, in Example 1-3, the junction portion core with the same shape was made of the iron powder core, the value of the inductance at a current with DC superposition of 20 A was 500 μH or more, of which the decrease compared to the initial inductance was suppressed to be 30% or less. Also, no iron loss was observed at a high frequency. Thus, it was quite necessary to use the soft magnetic metal powder core, the resistance of which was isotropic and quite high, for the junction portion core.

In Example 1-1, the junction portion core was circular, and in Examples 1-2 to 1-5, the junction portion core was rectangular. In all these cases, the inductance under DC superposition was 500 μH or more, of which the decrease relative to the initial inductance (600 μH) was suppressed to be 30% or less. In this respect, it can be confirmed that the inductance can be improved no matter how the junction portion core was shaped.

In Examples 1-3 and 1-5, the junction portion core was rectangular with a thickness of 1.0 mm, and in Examples 1-2 and 1-4 the junction portion core was rectangular with a thickness of 2.0 mm. In all these cases, the inductance under DC superposition was 500 μH or more, of which the decrease relative to the initial inductance (600 μH) was suppressed to be 30% or less. In this respect, it can be confirmed that the inductance can be improved regardless of the thickness of the junction portion core.

In Example 1-4, the junction portion core (35 mm×40 mm) was obtained by bonding two sheets of tabular magnetic cores (35 mm×20 mm) with a binder. In this case, the inductance under DC superposition was also 500 μH or more of which the decrease relative to the initial inductance (600 μH) was suppressed to be 30% or less. Thus, the junction portion core can also be a tabular magnetic core with a specified area obtained by bonding two or more sheets of tabular magnetic cores with small areas.

In Example 1-5, the junction portion core (the length of sides was 40 mm) was disposed to face the yoke portion core. As the length of the yoke portion core was 80 mm, two junction portion cores were disposed to contact to each other. In this case, the inductance under DC superposition was also 500 μH or more of which the decrease relative to the initial inductance (600 μH) was suppressed to be 30% or less. Thus, the junction portion cores can also be disposed to contact to each other.

In addition, when the area of the junction portion core was larger than 4.0 times that of the section of the winding portion core, the area of the junction portion core would be larger than 1810 $mm^2$. If two junction portion cores were combined, the area would exceed 3620 $mm^2$. Such an area would be larger than that of the bottom of the yoke portion core which was 3600 $mm^2$ (80 mm in length×45 mm in width), so the junction portion core could not be arranged if the yoke portion core did not increase in size. In other words, the requirement of miniaturization could not be met.

In Examples 1-2 and 1-4, gaps (0.15 mm) were inserted between the yoke portion cores and the junction portion cores and no gap was inserted in Examples 1-3 and 1-5. In all these cases, the inductances were 500 μH or more, of which the decrease relative to the initial inductance (600 μH) was suppressed to be 30% or less. Thus, with the insertion of a gap in the space between the yoke portion core and the junction portion core, the improvement effect on the inductance would no deteriorate and the initial inductance could be easily adjusted.

Example 2

With respect to the embodiment shown in FIG. 2, the properties were compared based on the presence of the junction portion core 14 or not.

Example 2-1

The yoke portion core 11 was a MnZn ferrite (PC90, produced by TDK Corporation) core shaped like "□", wherein, the back part had a length of 80 mm, a width of 60 mm and a thickness of 10 mm, and the foot parts had a length of 14 mm, a width of 60 mm and a thickness of 10 mm.

A FeSi alloy powder core was used for the winding portion core. The FeSi alloy powder had a composition of Fe-4.5% Si. The alloy powder was prepared by water atomization, and the diameter was adjusted by a screening process to have an average particle size of 50 μm. A silicone resin was added into the obtained FeSi alloy powder in an amount of 2 mass %, and the mixture was mixed for 30 minutes at room temperature in a pressurized kneader. Then, the resin was coated on the surface of the soft magnetic powder. The resultant mixture was subjected to a finishing process using a mesh with an aperture of 355 μm to prepare particles. The obtained particles were filled into a mold coated with zinc stearate as the lubricant, and a pressing forming was performed under a pressure of 980 MPa to provide a molded body with a height of 24 mm and a diameter of 24 mm. The molded body was annealed at 700° C. under an atmosphere of nitrogen. Two of the obtained FeSi alloy powder cores were bonded to provide one set of winding portion core.

An iron powder core was used for the junction portion core which was made into a rectangular plate with an area of 900 $mm^2$ (30 mm×30 mm) and a thickness of 1 mm. The method for preparing the iron powder core was the same as that in Example 1.

As shown in FIG. 2, the yoke portion cores face to each other to form a magnetic loop shaped like "□", and into the central part one set of winding portion core was disposed. The junction portion cores were disposed at the two spaces where the yoke portion cores faced the winding portion core. The junction portion core was disposed in a manner that the whole end part of the winding portion core faced the junction portion core and the whole area of the junction portion core faced the yoke portion core. A coil with a number of turns of 38 was wound around the winding portion core to prepare a reactor (Example 2-1).

Comparative Example 2-1

A reactor (Comparative Example 2-1) was prepared as in Example 2-1 except that no junction portion core was disposed.

The inductance and the iron loss at a high frequency were evaluated on the obtained reactors (Example 2-1 and Comparative Example 2-1).

The DC superposition characteristics of the inductance were measured in the same way as in Example 1. The material for gap was inserted into the two spaces between the junction portion cores and the winding portion core in Example 2-1 and the material for gap was inserted into the two spaces between the yoke portion cores and the winding portion core in Comparative Example 2-1 to obtain an initial inductance of 570 μH when no DC current was applied. The PET films each with a thickness of 0.1 mm were staked to be used as the material for gap. Before the material for gap was to be inserted, the heights of the foot parts were adjusted by grinding so as to eliminate the spaces between the opposite loot portions of the ferrite cores. Regarding the DC superposition characteristics, the inductances were measured when the rated current was 20 A, and the results were shown in Table 2.

The iron losses at a high frequency were measured in the same way as in Example 1. The f was set to be 20 kHz and Bm was set to be 50 mT in the measurement of the iron loss. The excitation coil had a number of turns of 25 and the search coil had a number of turns of 5. These two coils were wound around the winding portion core to perform the measurement. The results obtained from the measurement of iron loss were shown in Table 2.

As can be seen from Table 2, in the reactor of Comparative Example 2-1, the inductance at a current with DC superposition of 20 A was only 280 μH which was decreased by a level more than 50% compared to the initial inductance (570 μH). On the other hand, in the reactor of Example 2-1, the inductance at a current with DC superposition of 20 A was 490 μH of which the decrease relative to the initial inductance (570 μH) was suppressed to be 30% or less. Further, it had also been confirmed that no increase of the iron loss at a high frequency was observed.

If Example 1-3 was compared with Example 2-1 in which the area ratio was the same (S2/S1=1.99), a decrease of iron loss at a high frequency was observed in Example 2-1. When one set of winding portion core was disposed as shown in the embodiment of FIG. 2, the percentage occupied by the ferrite core was increased in the magnetic loop of the composite magnetic core so the loss could be effectively reduced by taking advantage of the low loss of the ferrite.

In Example 2-1, a gap (0.5 mm) was inserted between the winding portion core and the junction portion core. The inductance under DC superposition was decreased by a level suppressed to be 30% or less compared to the initial inductance (600 μH). Therefore, with the insertion of the gap at the space between the winding portion core and the junction portion core, the improvement effect on the inductance would not be deteriorated and the initial inductance could be easily adjusted.

As described above, the reactor of the present invention has the loss decreased and also has a high inductance even under DC superposition so that a high efficiency and miniaturization can be realized. Therefore, such a reactor can be widely and effectively used in an electric or magnetic device such as a circuit of a power supply or a power conditioner.

DESCRIPTION OF REFERENCE NUMERALS

10. reactor
11. yoke portion core
12. winding portion core
13. coil
14. junction portion core
15. gap
21. ferrite core
22. soft magnetic metal core
23. magnetic flux
24. junction portion core

TABLE 2

| | No. | Cross sectional area of the winding portion S1 [$mm^2$] | Shape of the junction portion core ([mm]) | Thickness of the junction portion core [mm] | Area of the junction portion core S2 [$mm^2$] | Area ratio S2/S1 | Inductance L at 0 A [μH] | Inductance L at 20 A [μH] | Reduction rate of L ΔL/L0 | Iron loss at a high frequency Pc 20 kHz, 50 mT [W] |
|---|---|---|---|---|---|---|---|---|---|---|
| Example | 2-1 | 452 | Rectangular plate (30 × 30) | 1.00 | 900 | 1.99 | 570 | 490 | −14% | 0.81 |
| Comparative Example | 2-1 | 452 | None | — | — | — | 570 | 280 | −51% | 0.93 |

What is claimed is:

1. A reactor comprising:

a pair of yoke portion cores composed of ferrite;

a winding portion core spanning the yoke portion cores, the winding portion core being composed of soft magnetic metal and having a substantially constant cross sectional area;

a coil winding around the winding portion core; and junction portion cores composed of soft magnetic metal powder and having a tabular shape disposed at spaces where the winding portion core faces the yoke portion cores, an area of a part where each of the junction portion cores faces each of the yoke portion cores is 1.3 to 4.0 times the cross sectional area of the winding portion core.

2. The reactor of claim 1, further comprising:

gaps provided at spaces where the yoke portion cores face the junction portion cores.

3. The reactor of claim 1, further comprising:

gaps provided at spaces where the winding portion core faces the junction portion cores.

4. The reactor of claim 1, comprising a plurality of winding portion cores with a respective plurality of coils.

* * * * *